US007180461B2

(12) United States Patent
Petropoulos et al.

(10) Patent No.: US 7,180,461 B2
(45) Date of Patent: Feb. 20, 2007

(54) WIDEBAND OMNIDIRECTIONAL ANTENNA

(75) Inventors: Anthanasios G. Petropoulos, Lowell, MA (US); Jarrett Morrow, Bow, NH (US)

(73) Assignee: Cushcraft Corporation, Manchester, NH (US)

( * ) Notice: Subject to any disclaimer, the term of this patent is extended or adjusted under 35 U.S.C. 154(b) by 0 days.

(21) Appl. No.: 11/190,649

(22) Filed: Jul. 27, 2005

(65) Prior Publication Data

US 2006/0082515 A1 Apr. 20, 2006

Related U.S. Application Data

(60) Provisional application No. 60/619,469, filed on Oct. 15, 2004.

(51) Int. Cl.
*H01Q 9/28* (2006.01)

(52) U.S. Cl. ..... 343/795; 343/793

(58) Field of Classification Search ..... 343/700 MS, 343/793, 795, 797

See application file for complete search history.

(56) References Cited

U.S. PATENT DOCUMENTS

| | | | | |
|---|---|---|---|---|
| 3,836,976 | A * | 9/1974 | Monser et al. | 343/795 |
| 4,686,536 | A * | 8/1987 | Allcock | 343/700 MS |
| 4,978,965 | A * | 12/1990 | Mohuchy | 343/727 |
| 6,359,596 | B1 * | 3/2002 | Claiborne | 343/795 |
| 2004/0056812 | A1 * | 3/2004 | Sabet et al. | 343/725 |
| 2005/0162332 | A1 * | 7/2005 | Schantz | 343/795 |
| 2006/0187135 | A1 * | 8/2006 | Maniwa et al. | 343/795 |

* cited by examiner

*Primary Examiner*—Tan Ho
(74) *Attorney, Agent, or Firm*—Hayes Soloway PC

(57) ABSTRACT

An omnidirectional antenna and method of producing the omnidirectional antenna is provided. Generally, the antenna has a first board with a ground plane on a first side of the first board and a second board with one or more dipole antennas located next to a first edge of the second board and one or more dipole antennas located next to a second edge opposite the first edge. The second board is located approximately perpendicular to the first board and approximately centered about the first board.

14 Claims, 13 Drawing Sheets

150

152

154

WIDEBAND OMNIDIRECTIONAL ANTENNA

CROSS REFERENCE TO RELATED APPLICATION

This application claims priority to copending U.S. Provisional Application entitled, "Wideband Omnidirectional Antenna," having Ser. No. 60/619,469 filed Oct. 15, 2004, which is entirely incorporated herein by reference

FIELD OF THE INVENTION

The present invention is generally related to wideband antennas, and more particularly is related to a compact omnidirectional antenna.

BACKGROUND OF THE INVENTION

An important consideration in the selection and design of antennas is the propagation pattern of the free-space propagating electromagnetic wave. In a typical application, a transmitting antenna will transmit a guided electromagnetic wave to and from another antenna located on a device. The receiving antenna can be located in any number of directions from the transmitting antenna. Consequently, it is essential that the antennas for such wireless communication devices have an electromagnetic propagation pattern that radiates in all directions.

Another important factor to be considered in designing antennas for wireless communication devices is bandwidth of the antennas. Antennas need to operate at the specific bandwidth of the wireless device. Accordingly, antennas for use on these types of wireless communication devices are designed to meet the appropriate bandwidth requirements, otherwise communication signals will be severely attenuated.

The demand for compact and inexpensive antennas has increased as wireless communication has become commonplace in a variety of applications. Personal wireless communication devices, for example, cellular phones and Personal Data Assistants (PDAs) have created an increased demand for compact antennas. The increase in satellite communication has also increased the demand for antennas that are compact and provide reliable transmission. In addition, the expansion of wireless local area networks at home and work has also necessitated the demand for antennas that are compact and inexpensive.

The growing demand for wireless communication links in the 5.150–5.875 GHz bandwidth range requires low cost omnidirectional radiators. Moreover, these radiators should exhibit wideband operation and high gain. The radiation pattern is required to be omnidirectional in the azimuth direction with small variation in the gain in all directions (typically less than 2 decibels (dB)).

The above requirements make the design of these radiators challenging. While series-fed collinear radiators provide enough gain and radiate in an omnidirectional pattern, they are inherently narrowband and the main lobe radiation beam is frequency dependent in the elevation plane.

One way to increase the bandwidth of antennas is to make a corporate network feeding multiple broadband radiating elements. The corporate network comprises the feed lines that supply the feed signal. Using multiple radiating elements have to overcome the problems associated with limited space within the antenna enclosure, along with placing the broadband radiating elements in a pattern to radiate in all directions.

Planar structures have been proposed to include corporate networks and the radiating elements on the same plane. This kind of construction has the advantage of low cost and manufacturing repeatability, but it comes with disadvantages. The number of feeding lines for the corporate network as well as radiating elements is limited by the width of the board supporting the antenna components. Slot radiators placed along the board, fed by microstrip feed lines, require a larger amount of space on the board and limit the number of microstrip feed lines for the corporate network. Moreover, the microstrip feed lines are located close to the slots, coupling unwanted electromagnetic energy. In addition, the radiation patterns produced by the slot radiators have a limited omnidirectional radiating pattern.

Thus, a heretofore unaddressed need exists in the industry to address the aforementioned deficiencies and inadequacies.

SUMMARY OF THE INVENTION

Embodiments of the present invention provide a system and method for providing an omnidirectional antenna. Briefly described, in architecture, one embodiment of the system, among others, can be implemented as follows. The system contains a first board with a ground plane on a first side of the first board. A second board is located approximately perpendicular to the first board at an approximate center of the first board. At least one pair of antennas is integral with the second board, wherein a first antenna of the at least one pair of antennas is located next to a first edge of the second board and a second antenna of the at least one pair of antennas is located next to a second edge of the second board, opposite the first edge.

The present invention can also be viewed as providing methods for providing an antenna. In this regard, one embodiment of such a method, among others, can be broadly summarized by the following steps: providing a first board; creating a ground plane on a first side of the first board; providing a second board; integrating at least one pair of antennas with the second board, wherein a first antenna of the at least one pair of antennas is located next to a first edge of the second board and a second antenna of the at least one pair of antennas is located next to a second edge opposite the first edge; and coupling the second board with the first board in a position approximately perpendicular to the first board and approximately centered about the first board.

Other systems, methods, features, and advantages of the present invention will be or will become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
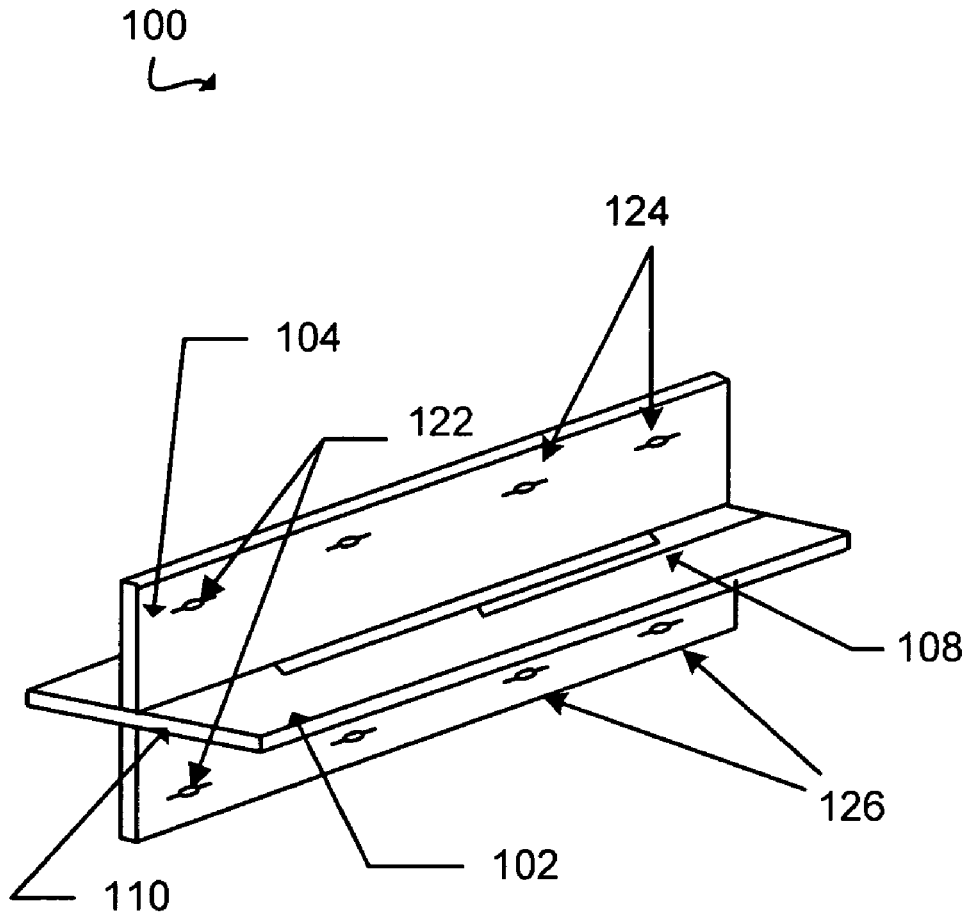
FIG. 1 is a perspective view of an omnidirectional antenna, according to a first exemplary embodiment of the invention.

FIG. 1 is a perspective view of an omnidirectional antenna 100, according to a first exemplary embodiment of the invention. The omnidirectional antenna 100 includes a first board 102 and a second board 104 located approximately perpendicular to the first board 102 at an approximate center of the first board 102. The omnidirectional antenna 100 overcomes the space limitations on planar boards and provides a broadband, omnidirectional radiation pattern. The first board 102 may contain at least a portion of a corporate feed network 108 and a ground plane 110. At least one pair of antennas 122 is integral with the second board 104. The pair of dipole antennas 122 includes a first dipole antenna 124 and a second dipole antenna 126. The second board 104, in the first exemplary embodiment, contains four pairs of dipole antennas 122 fed from the corporate feed network 108. The ground plane 110 acts as a reflector for radio frequency (RF) waves radiating from the pairs of dipole antennas 122. The positioning of the pairs of dipole antennas 122 around the ground plane 110, as shown in FIG. 1, allows the network of pairs of dipole antennas 122 to make efficient use of the space and provide an omnidirectional radiating pattern. Also, by locating at least a portion of the corporate feed network 108 on the first board 102, less of the corporate feed network 108 is required on the second board 104, which allows the second board 104 to be effective at a narrower width than with a similar, planar design.

Figure 2:
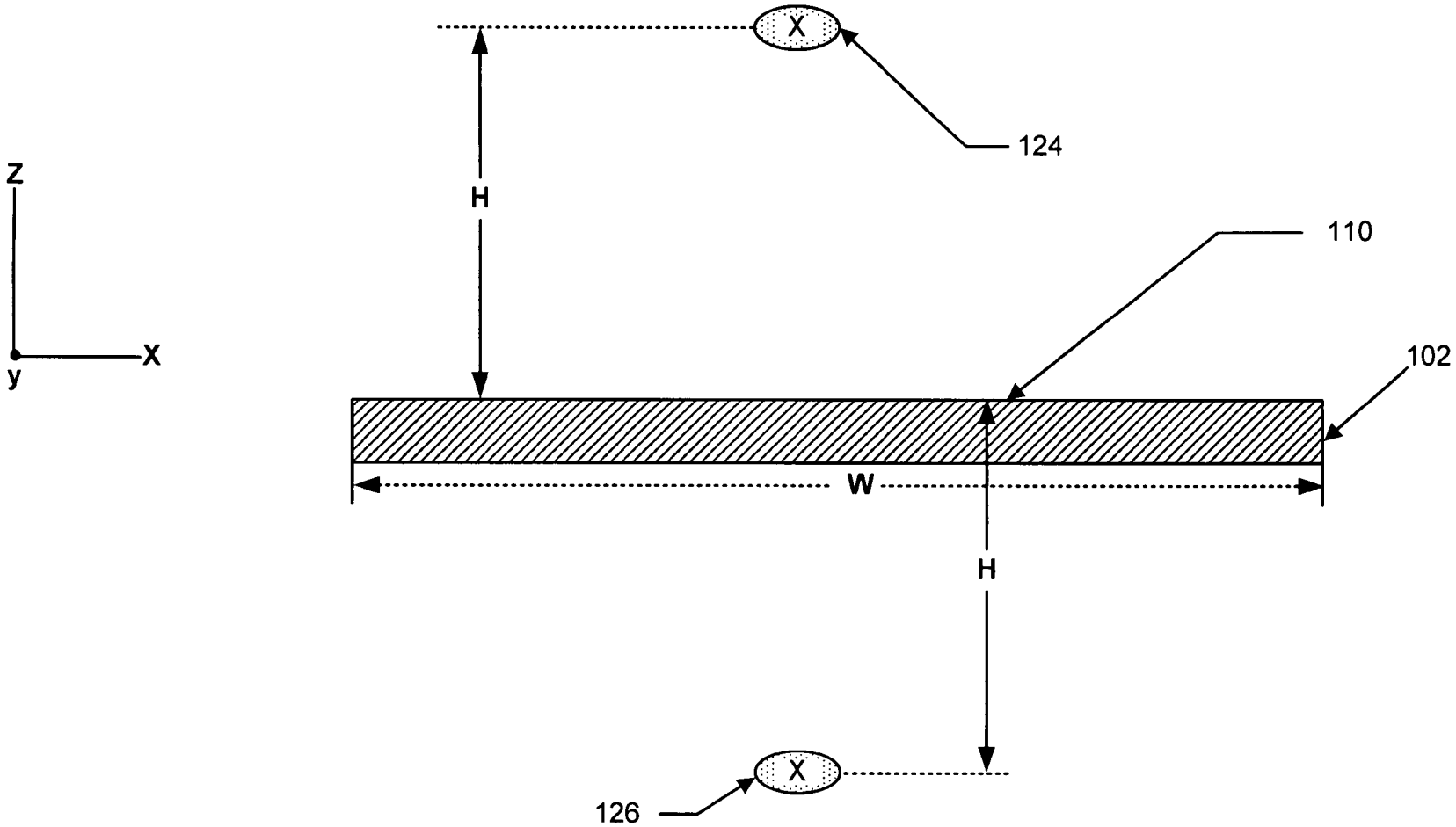
FIG. 2 is a diagram of the omnidirectional antenna of FIG. 1 showing the spacing of a ground plane and a plurality of dipole antennas, according to the first exemplary embodiment of the invention.

FIG. 2 is a diagram of the omnidirectional antenna 100 of FIG. 1 showing the spacing of a ground plane 110 and a plurality of dipole antennas 122, according to a first exemplary embodiment of the invention. The diagram of the omnidirectional antenna 100 is a model of the cross-section along the longitude direction of the antenna (y-axis). The combination of dipole antennas 124, 126 above and below the ground plane 110 with proper dimensions for the height H and width W radiate in an omnidirectional pattern. To illustrate the point, consider two extreme, hypothetical cases. The first hypothetical case involves a ground plane 110 with a large width W relative to the radiation pattern of the dipole antennas 124, 126 and the second hypothetical case involves no ground plane 110, i.e. zero width W. If there is no ground plane 110, the dipoles antennas 124, 126 form a radiation pattern radiating along the x-axis with a null along the z-axis. If the ground plane 110 is very large, the ground plane 110 operates as a reflector for the dipole antennas 124, 126. The radiation pattern produced is a maximum radiation along the z-axis and minimum radiation along the x-axis. An appropriate width W can be selected to produce a radiation pattern that produces a balance between radiating energy along the x-axis and the z-axis. By selecting a proper width W relative to the height H, the radiation along the x-axis and the z-axis are almost equal, making the radiation pattern almost omnidirectional in the x-z plane.

The width W can be determined empirically based on the frequency of the feed signal and the spacing of the dipole antennas 124, 126. In the example disclosed in the first exemplary embodiment, the width of the ground plane 110 is about 2.0 centimeters. The height H of the location of the dipole antennas 124, 126 may be approximately 1.0 centimeter. The above dimensions of height H and width W are exemplary. While it may be useful to use this ratio of approximately H=W/2 to create omnidirectional patterns with this antenna design, other ratios may be similarly effective in generating omnidirectional patterns and this ratio may not effectively generate an omnidirectional pattern for all heights H or widths W. Also, other heights H and/or widths W can be used depending on the desired radiation pattern and characteristics of the feed signal being propagated.

Figure 3:
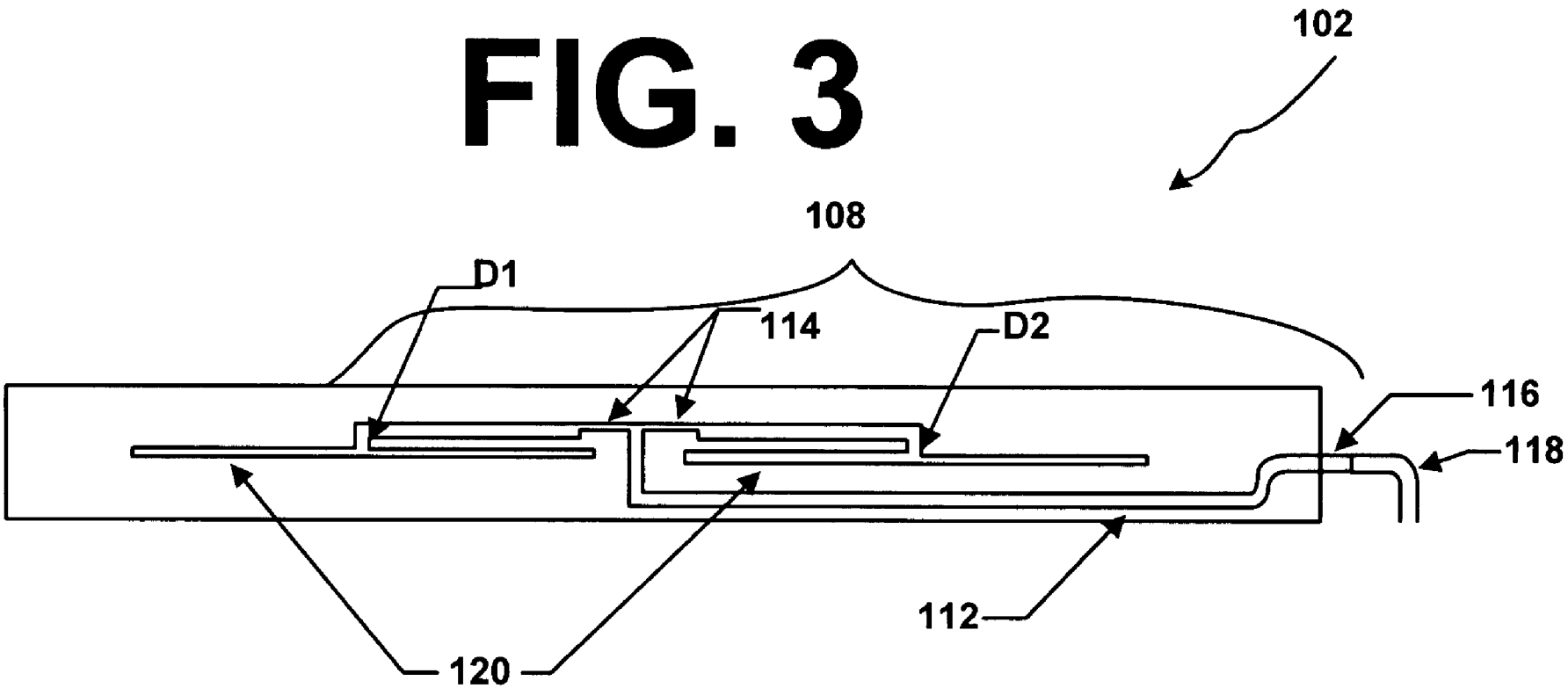
FIG. 3 is a top plain view of the first board of the omnidirectional antenna, according to the first exemplary embodiment of the invention.

FIG. 3 is a top plain view of the first board 102 of the omnidirectional antenna 100, according to the first exemplary embodiment of the invention. A microstrip feed line artery 112 on the first board 102 is part of the corporate feed network 108. The first board 102 contains most of the corporate feed network 108, which extends from an edge connector 116 to the pairs of dipole antennas 122 (shown in FIG. 1). The corporate feed network 108 is responsible for distributing the RF power to the radiating dipole antennas 124, 126 of the second board 104. A feed signal enters the corporate feed network 108 on the first board 102 through the edge connector 116. The edge connector 116 may, for example, receive the feed signal from a coaxial cable 118. The omnidirectional antenna 100 may be designed to have matching impedance with the coaxial cable 118. The ground plate 110 (as shown in FIG. 1) may be provided on an opposite side of the first board 102. A metal laminate on one side of the first board 102 can be used to form the ground plate 110.

The feed signal from the microstrip feed line artery 112, in the first exemplary embodiment, is divided equally into two separate paths through quarter wave transformers 114 formed by microstrip feed lines. The size and shape of the quarter wave transformers 114 are designed to provide matching and keep signal feedback to a minimum. Signal feedback occurs when the feed signal is reflected back towards the path of transmission of the feed signal. The quarter wave transformers 114 direct the feed signal to points D1 and D2 where they are electrically connected to the microstrip feed lines on the second board 104. The second board 104 is placed perpendicular to the first board 102 by entering the first board 102 through the slots 120. The slots 120 are sized to allow a lower portion of the second board 104 to fit within the slots 120 as will be described later herein. Those having ordinary skill in the art will recognize that other mechanical means may be employed for allowing the first board 102 and the second board 104 to be joined in a substantially perpendicular arrangement and those means are considered to be within the scope of the invention.

Figure 4A:
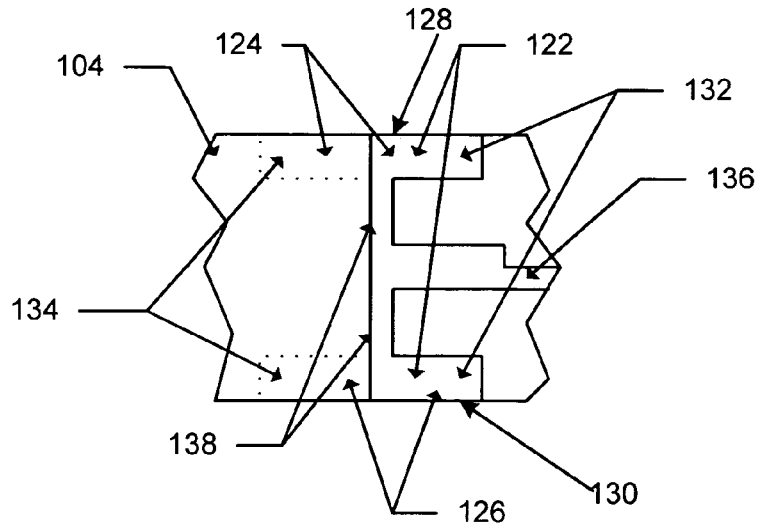
FIG. 4A is a front plain view of a single basic radiating section of the second board of the omnidirectional antenna, according to the first exemplary embodiment of the invention.

FIG. 4A is a front plain view of a single basic radiating section of the second board 104 of the omnidirectional antenna 100, according to the first exemplary embodiment of the invention. The basic radiating section has one pair of dipole antennas 122 reaching from a top edge 128 of the second board 104 to a bottom edge 130 of the second board 104. The first dipole antenna 124 of the pair of dipole antennas 122 is etched on the top edge 128 and the second dipole antenna 126 of the pair of dipole antennas 122 is etched at the bottom edge 130, as shown in FIG. 4A. Each dipole antenna 124, 126 consists of a first part 132 on the front side of the second board 104 and a second part 134 on the back side of the second board 104. The feed signal coming from the microstrip feed line vein 136 (shown in FIG. 4A) splits equally to twin lines 138 and eventually reaches the dipole antennas 124, 126 where it radiates into the air. The first board 102 (shown in FIG. 3) is located perpendicularly to the second board 104, approximately centered between the dipole antennas 124, 126.

Figure 4B:
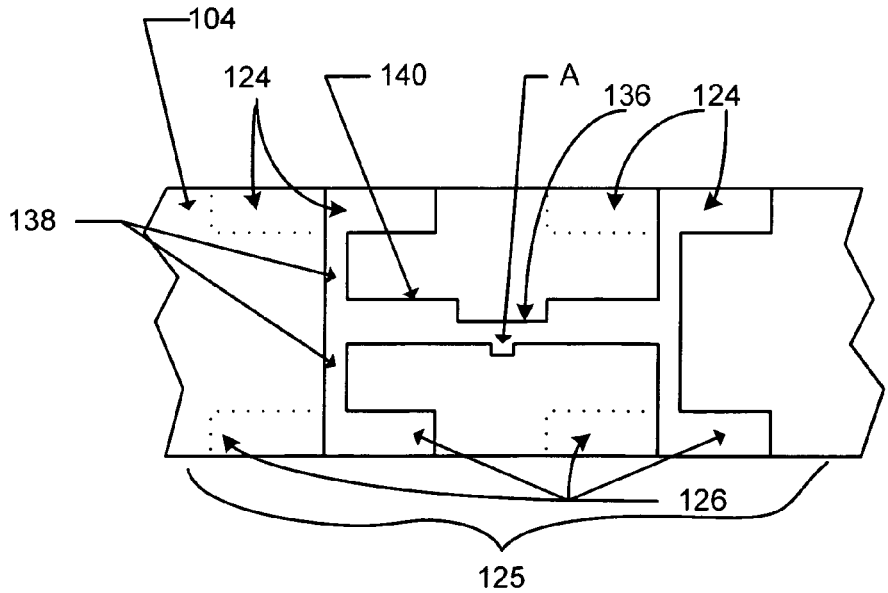
FIG. 4B is a front plain view of a radiating section cluster, as described in relation to FIG. 4A, according to the first exemplary embodiment of the invention.

FIG. 4B depicts a radiating section cluster 125, as described in relation to FIG. 4A, according to the first exemplary embodiment of the invention. The radiating section cluster 125 includes two of the basic radiating sections, as shown in FIG. 4A. The feed signal comes from the first board 102 (shown in FIG. 3) and is fed to the microstrip feed line vein 136 of FIG. 4B at edge C1. Edge C1 in FIG. 4B may be electrically connected with point D1 or D2 shown in FIG. 3. The connection will be described further in detail in the discussion associated with FIG. 6. The feed signal branches along the microstrip feed line vein 136. Balun structure 140 transitions the feed signal from the microstrip feed line vein 136 to the balanced twin lines 138. Eventually the feed signal reaches the dipole antennas 124, 126 and radiates into the surround space. Multiple radiating section clusters 125 may be combined and are located on the second board 104.

Figure 5A:
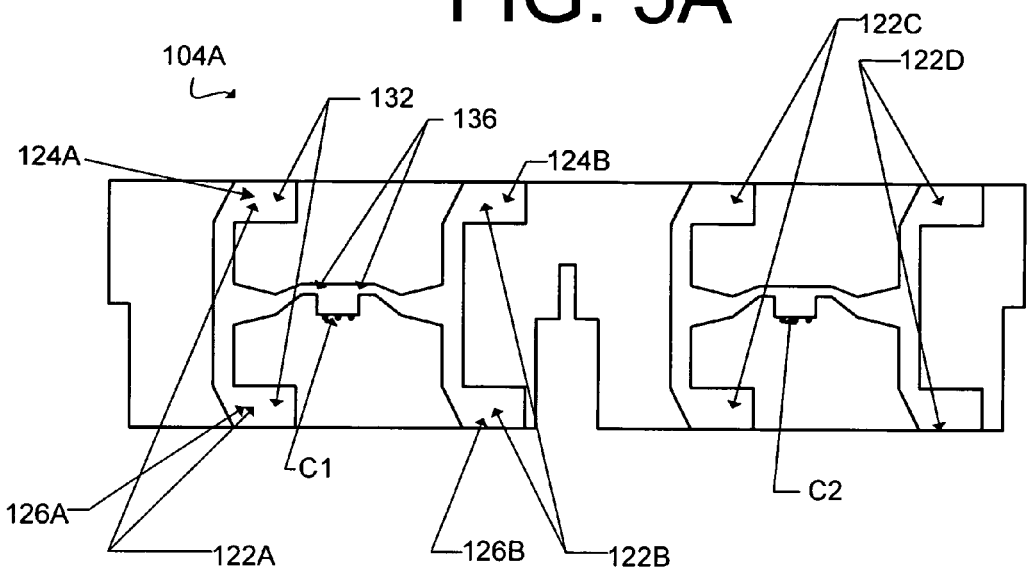
FIG. 5A is a top plain view of a first side of the second board of the omnidirectional antenna, according to the first exemplary embodiment of the invention.
Figure 5B:
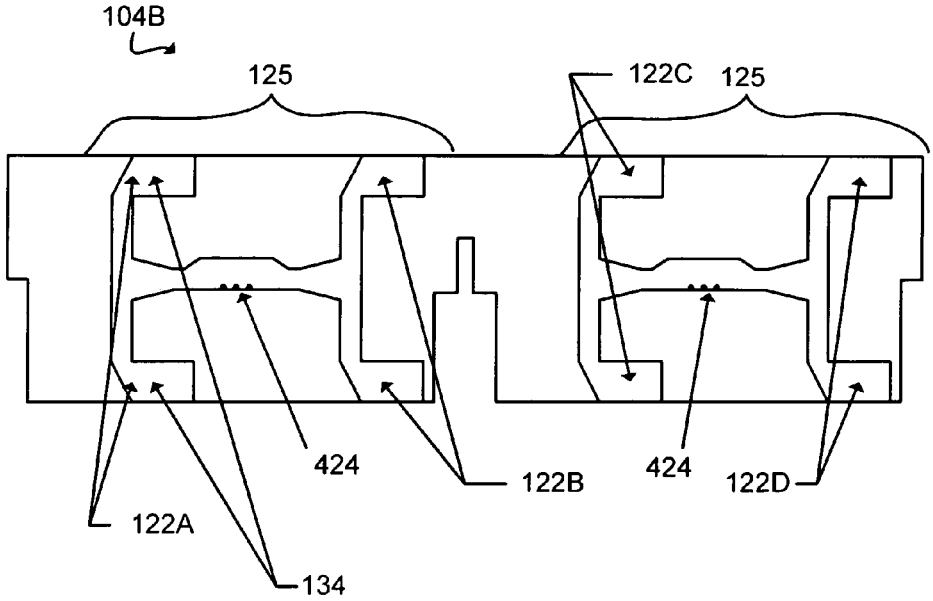
FIG. 5B is a bottom plain view of a bottom side of the second board of the omnidirectional antenna, according to the first exemplary embodiment of the invention.

FIG. 5A is a top plain view of a first side 104A of the second board 104 of the omnidiretional antenna according to the first exemplary embodiment of the invention. FIG. 5B is bottom plain view of a bottom side 104B of the second board 104 of the omnidirectional antenna 100, according to the first exemplary embodiment of the invention. The first side 104A, in accordance with the first exemplary embodiment, has four pairs of dipole antennas 122A, 122B, 122C, 122D. The first pair of dipole antennas 122A are on the far left portion of the first side 104A, as shown in FIG. 5A. The first pair of dipole antennas 122A contains a first dipole antenna 124A near the top edge of the second board 104 and second dipole antenna 126A near the bottom edge of the second board 104. The second pair of dipole antennas 122B are to the right of the first pair of dipole antennas 122A on the second board 104 as shown in FIG. 4A. The second pair of dipole antennas 122B contain a third dipole antenna 124B near the top edge of the second board 104 and a fourth dipole antenna 126B near the bottom edge of the second board 104. The third pair of dipole antennas 122C and fourth pair of dipole antennas 122D are similarly located on the first side 104A.

As previously discussed, each pair of dipole antennas 122 has a first part 132 and a second part 134. The first part 132 is located on the first side 104A of the second board 104 as shown in FIG. 5A. The second part 134 is located on a second side 104B of the second board 104, opposite the first side 104A, as shown in FIG. 5B.

The feed signal from the coaxial cable 118 is fed from microstrip feed line artery 112 of the first board 102 to microstrip feed line vein 136 of the second board 104. The microstrip feed line vein 136 receives the feed signal and further splits and guides the feed signal to each dipole antenna 124, 126. In this way, the corporate network 108 feeds the feed signal to each dipole antenna 124, 126. The dipole antenna 124, 126 produces Radio Frequency (RF) waves with a radiating pattern around each dipole antenna 124, 126. The ground plane 110 reflects RF waves radiating from the dipole antennas 124, 126. By centering the ground plane 110 in between the dipole antennas 124, 126 an almost omnidirectional radiating pattern is produced.

Figure 6:
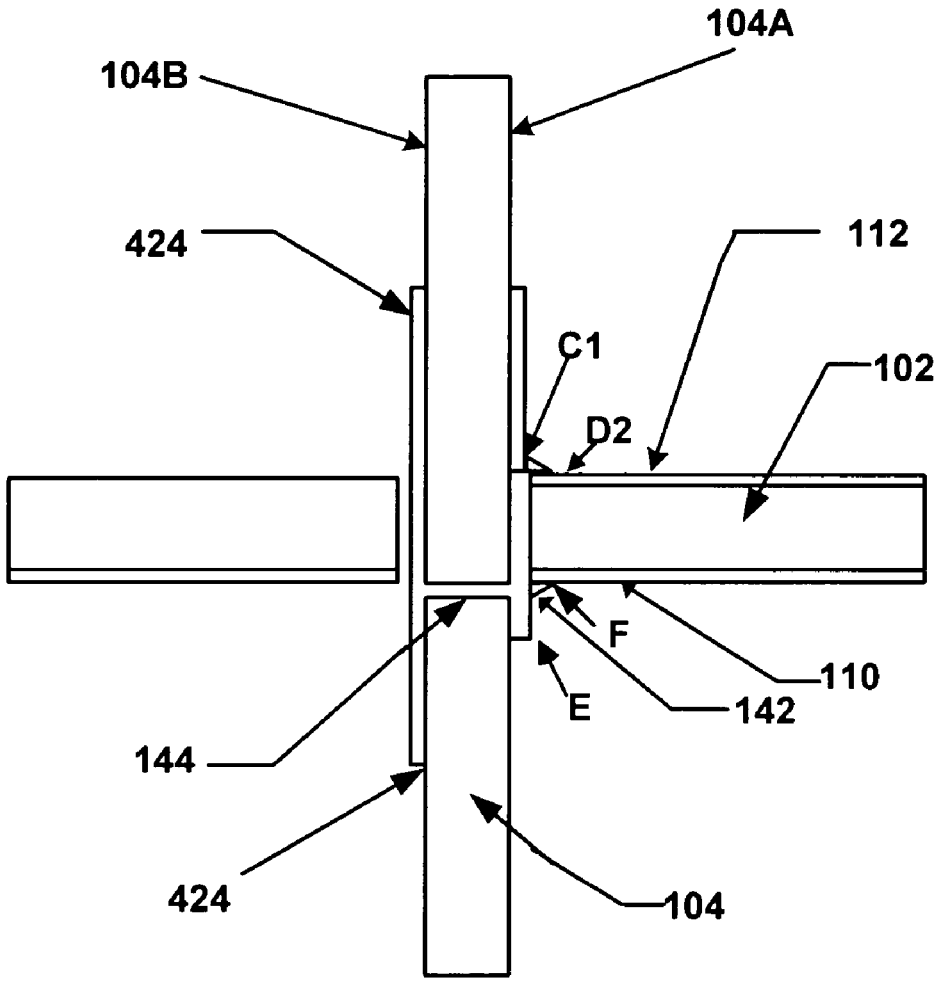
FIG. 6 is a cross-sectional view of the omnidirectional antenna, according to the first exemplary embodiment of the invention.

FIG. 6 is a cross-sectional view of the omnidirectional antenna 100, according to the first exemplary embodiment of the invention. As can be seen, the first board 102 and the second board 104 orthogonally intersect at an approximate mid-section of the first board 102 and an approximate mid-section of the second board 104. The cross-sectional view shows the point where microstrip feed lines from the orthogonal boards 102 and 104 are connected. The first board 102 and second board 104 can be produced separately. One exemplary method for producing the first board 102 and second board 104 involves applying a metal laminate to each planar surface of a non-conductive structural member. The first board 102 and second board 104 are etched to produce the desired pattern forming the dipole antennas 124, 126 and corporate network 108. The first board 102 and second board 104 are cut or punched to produce the desired shape of the boards. The second board 104, composed of a plurality of radiating section clusters 125 is positioned within the slots 120 of the first board 102 as shown in FIG. 1 and FIG. 5.

Connection edge C1, shown in FIG. 5A and integral with the microstrip feed line vein 136 on the second board 104, is connected to the point D1, shown in FIG. 3 on the microstrip feed line artery 112 on the first board 102. The connection is made, for example, by solder. Similarly, connection edge C2, connected to the microstrip feed line vein 136 on the second board 104, is soldered to the point D2, of the microstrip feed line artery 112 on the first board 102. Plated through-holes 144 can be made in the second board 104 to provide an accessible electrical coupling between the ground lines 424 of the microstrip feed line vein 136 of the second board 104 to the ground plane 110 in the first board 102. Point E on the plated through-holes 144 of the second board 104 is electrically connected (solder 142) to point F on the ground plane 110 as shown in FIG. 6. Edge C1 of second board 104 is electrically connected (solder 142) to point D2 of first board 102. Edge C2 (shown in FIG. 5A) of second board 104 is electrically connected (soldered) to point D1 (shown in FIG. 3) of first board 102 (this connection is not shown). These electrical connections transition the feed signal from the first board 102 to the second board 104. The electrical couplings between the first board 102 and second board 104 can be electrically coupled using, for example but not limited to, solder, conductive bonding agent, or conductive tape. The soldered electrical couplings between the first board 102 and second board 104 can produce a structure that is rigid and mechanically strong.

The first board 102 and second board 104 are placed in a cylindrical tube with a bottom and top cover. The tube may be made of, for example, plastic. The tube allows the RF waves to radiate and pass through the tube, while physically protecting the first board 102 and second board 104 from the surrounding environment. The edge connector 116, as shown in FIG. 3, can be placed through an aperture of the tube to allow an external coupling of the coaxial cable 118. The cylindrical tube is just one example of a protective housing. A variety of other protective housings known to those having ordinary skill in the art can be used and are contemplated for this invention.

As previously discussed, placing a ground plane 110 between pairs of dipole antennas 122 alters the radiating pattern of RF waves. Selecting an appropriate height H between the ground plane 110 and the dipole antennas 124, 126 along with the width W of the ground plane 110 can produce an omnidirectional radiating pattern on the x-z plane, and a directional pattern along y-z plane.

Figure 7:
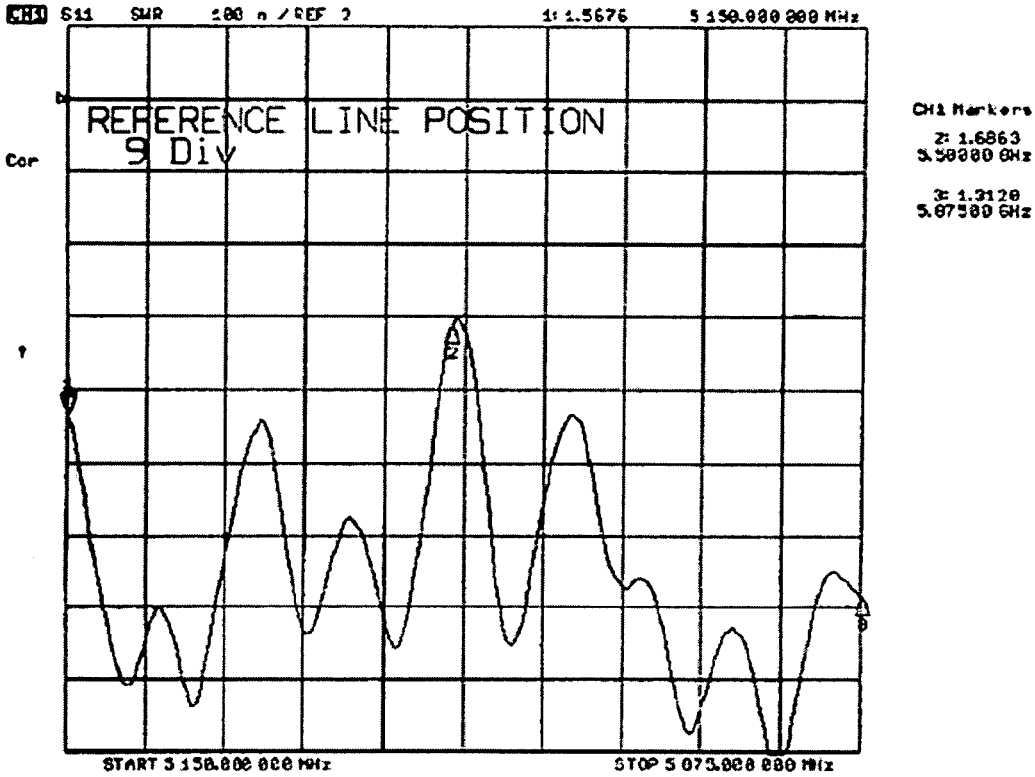
FIG. 7 shows a voltage stand wave ration (VSWR) plot of the omnidirectional antenna at the 5.150–5.875 GHz band.
Figure 8:
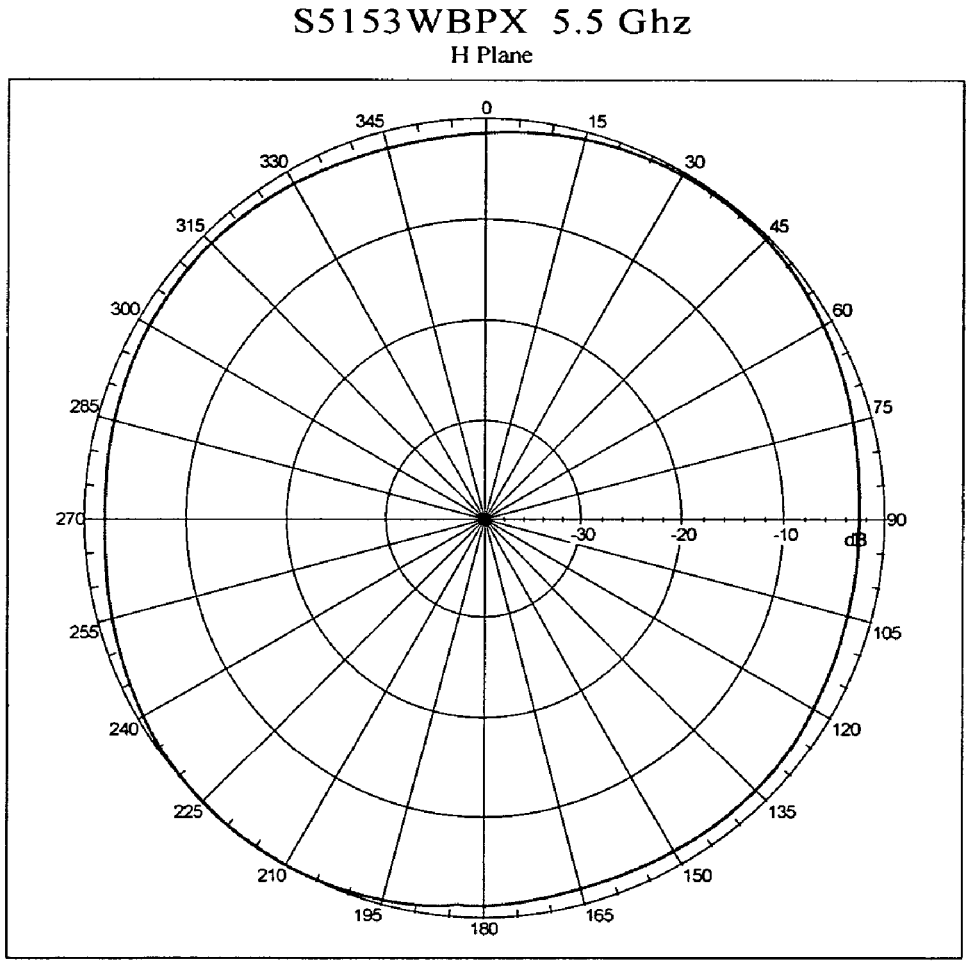
FIG. 8 shows an azimuth radiation pattern at 5.5 GHz band.
Figure 9:
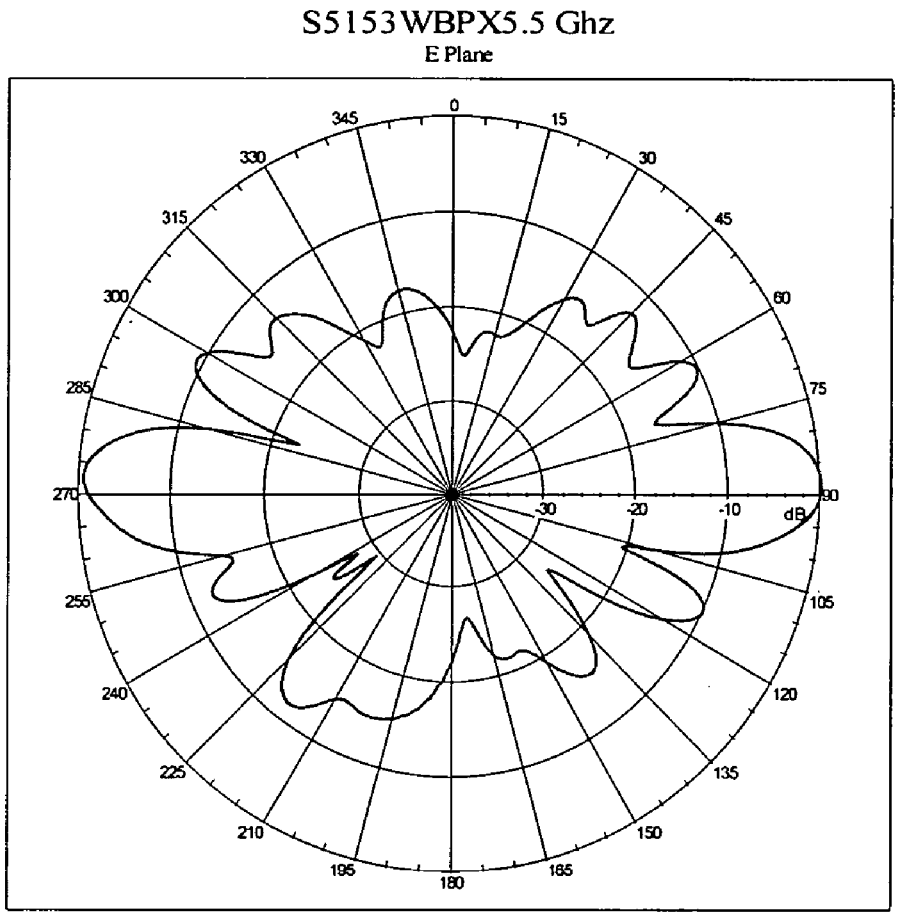
FIG. 9 shows an elevation radiation pattern at 5.5 GHz band.

The omnidirectional antenna 100, with four pairs of dipole antenna 122 according to the first exemplary embodiment of the invention, can be coupled to a coaxial cable 118, such as a 36-inch LMR-195 cable with a reversed TNC connector. FIG. 7 shows a voltage stand wave ratio (VSWR) plot 150 of the omnidirectional antenna at the 5.150–5.875 GHz band. The plot 150 shows a VSWR less than 1.5:1 across the 5.150–5.875 GHz band. FIG. 8 shows an azimuth radiation pattern 152 at 5.5 GHz band. The measured gain is approximately 6.8 decibels based on an isotropic radiating pattern (dBi) with a ripple of about 2 decibles (dB). FIG. 9 shows an elevation radiation pattern 154 at 5.5 GHz band. FIG. 9 shows side lobes are about 10 dB below the main lobe.

Figure 10:
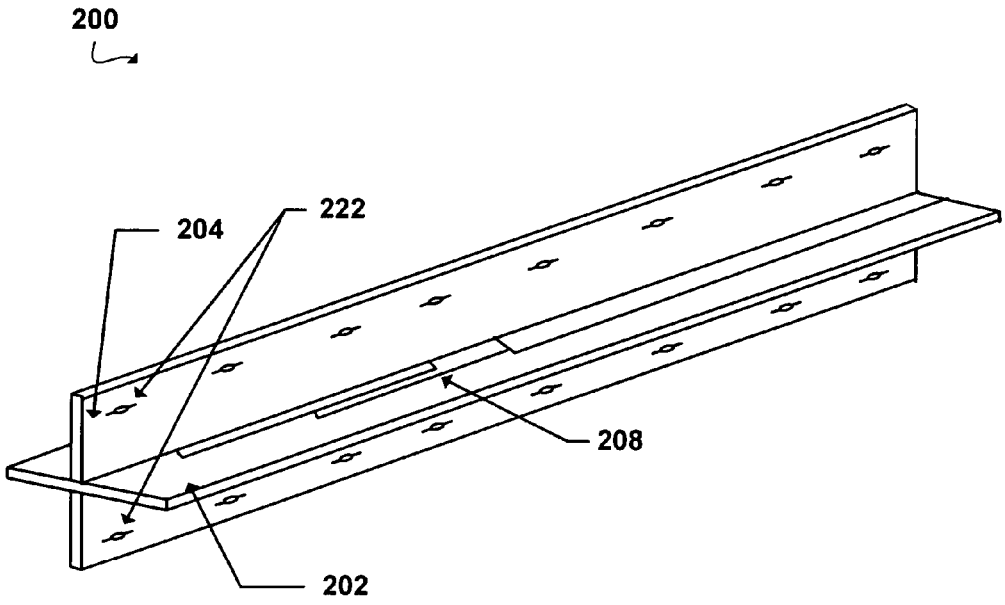
FIG. 10 is a perspective view of the omnidirectional antenna, according to a second exemplary embodiment of the invention.

The omnidirectional antenna 100 can be extended to eight pairs of dipole antennas 122 that will increase the gain of the radiator to 8–9 dBi. FIG. 10 is a perspective view of the omnidirectional antenna 200, according to a second exemplary embodiment of the invention. A first board 202 and a second board 204 are increased in length to incorporate a proportionally larger corporate feed network 208 and space needed for eight pairs of dipole antennas 222.

Figure 11:
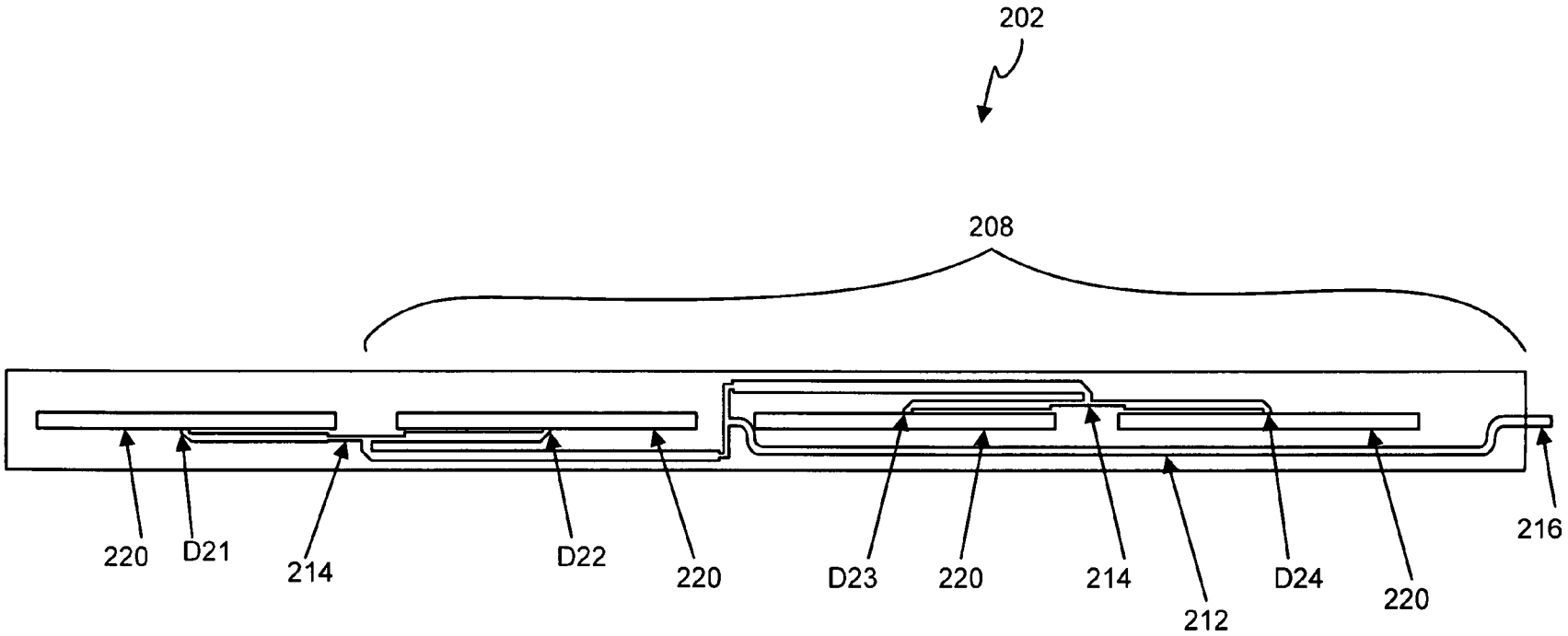
FIG. 11 is a top plain view of the first board of the omnidirectional antenna, according to the second exemplary embodiment of the invention.

FIG. 11 is a top plain view of the first board 202 of the omnidirectional antenna 200, according to the second exemplary embodiment of the invention. A microstrip feed line artery 212 on the first board 202 is part of the corporate feed network 208. The first board 202 contains most of the corporate feed network 208, which extends from an edge connector 216 to the pairs of dipole antennas 222 (shown in FIG. 10). The corporate feed network 208 is responsible for distributing the RF power to the radiating pairs of dipole antennas 222 of the second board 204. A feed signal enters the corporate feed network 208 on the first board through the edge connector 216. The edge connector 216 may, for example, receive the feed signal from a coaxial cable. The omnidirectional antenna 200 may be designed to have matching impedance with the coaxial cable (not shown). A ground plate (not shown) may be provided on an opposite side of the first board 202. A metal laminate on one side of the first board 202 can be used to form the ground plate (not shown).

The feed signal from the microstrip feed line artery 212, in the second exemplary embodiment, is divided equally into two separate paths through quarter wave transformers 214 formed by microstrip feed lines. The size and shape of the quarter wave transformers 214 are designed to provide matching and keep signal feedback to a minimum. Signal feedback occurs when the feed signal is reflected back towards the path of transmission of the feed signal. The quarter wave transformers 214 direct the feed signal to points D21, D22, D23, and D24 where they are electrically connected to the microstrip feed lines on the second board 204. The second board 204 is placed perpendicular to the first board 202 by entering the first board 202 through the slots 220. The slots 220 are sized to allow a lower portion of the second board 204 to fit within the slots 220 as described herein. Those having ordinary skill in the art will recognize that other mechanical means may be employed for allowing the first board 202 and the second board 204 to be joined in a substantially perpendicular arrangement and those means are considered to be within the scope of the invention.

Figure 12A:
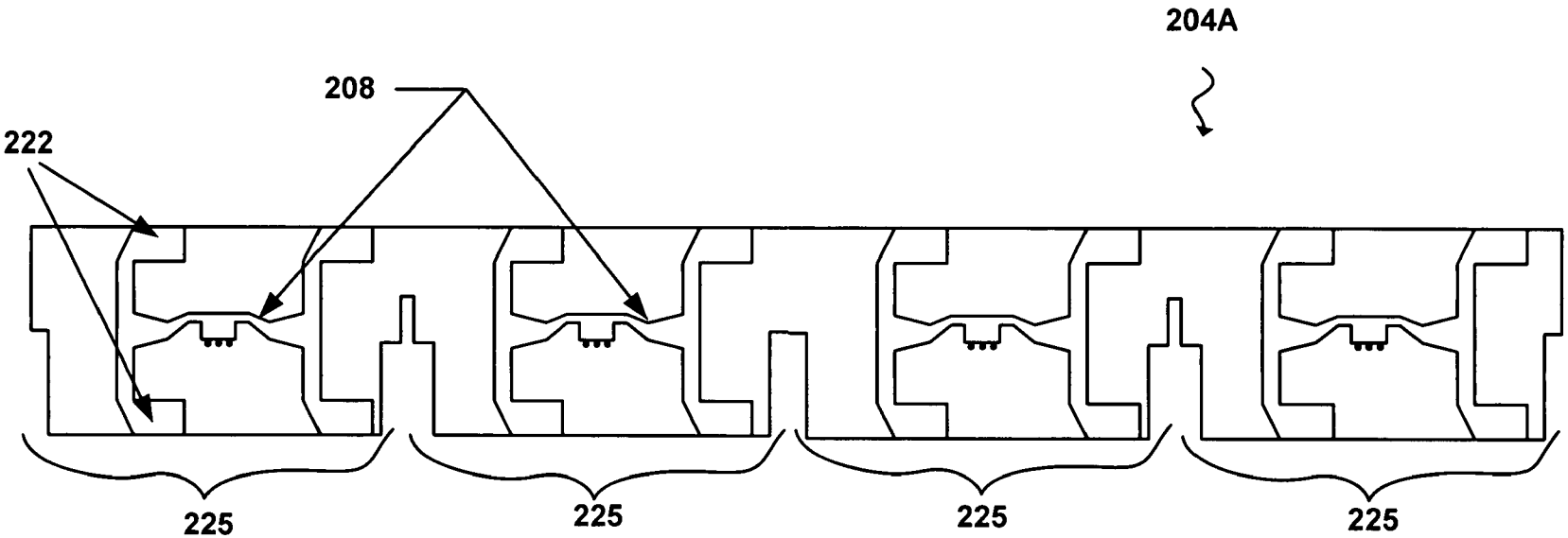
FIG. 12A is a top plain view of a first side of the second board of the omnidirectional antenna, according to the second exemplary embodiment of the invention.

FIG. 12A is a top plain view of a first side 204A of the second board 204 of the omnidirectional antenna 200, according to the second exemplary embodiment. The four slots 220 along the first board 202 accept four radiating section clusters 225. The four radiating section clusters 225 are located on the second board 204 perpendicular to the first board 202. The second board 204 provides adequate space to expand the corporate network 208 of microstrip feed lines to the additional pairs of dipole antenna 222.

Figure 12B:
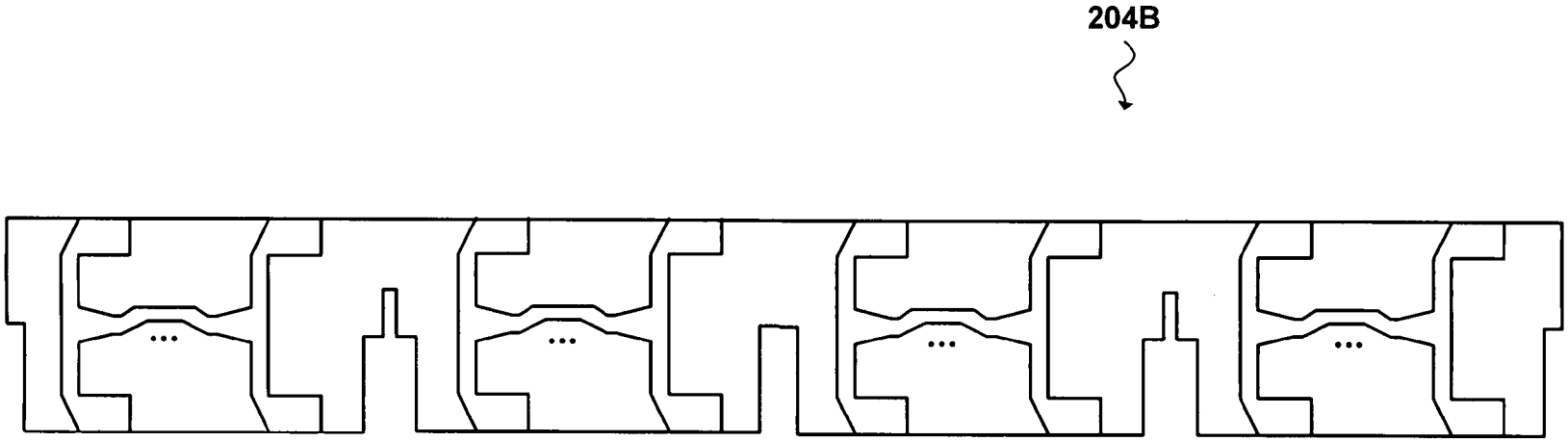
FIG. 12B is a bottom plain view of the second side of the second board of the omnidirectional antenna, according to the second exemplary embodiment of the invention.

FIG. 12B is a bottom plain view of a second side 204B of the second board 204 of the omnidirectional antenna 200, according to the second exemplary embodiment of the invention. The radiating pattern produced is similar to the omnidirectional antenna 200 of the second embodiment. Using twice as many radiating section clusters 225 produces a larger dipole array, which increases gain. The array of pairs of dipole antennas 222 is not limited to 4 pairs or 8 pairs, but may include as many pairs as desirable, based at least partially on desired gain.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. An antenna, comprising:

a first board with a ground plane on a first side;

a second board located approximately perpendicular to the first board at an approximate center of the first board; and at least one pair of antennas integral with the second board, wherein a first antenna of the at least one pair of antennas is located next to a first edge of the second board and a second antenna of the at least one pair of antennas is located next to a second edge opposite the first edge.

2. The antenna of claim 1, wherein the at least one pair of antennas further comprises at least one pair of dipole antennas.

3. The antenna of claim 1, further comprising a corporate network at least partially on a second side of the first board, opposite the first side, the corporate network electncally connected to the at least one pair of antennas.

4. The antenna of claim 1, further comprising an omni-directional radiating pattern emanating from the first and second boards.

5. The antenna of claim 1, wherein the at least one pair of antennas further comprises at least four pairs of dipole antennas.

6. The antenna of claim 1, further comprising a ground line mounted on the second board and connected to the ground plane.

7. The antenna of claim 1, further comprising at least one slot in the first board and at least a portion of the second board positioned within the slot.

8. The antenna of claim 1, further comprising a corporate network of microstrip feed lines mounted on the first board and the second board, the corporate network connecting the at least one pair of antennas to an edge connector.

9. The antenna of claim 8, further comprising a coaxial cable connected to the edge connector.

10. A method of providing an antenna, comprising the steps of:

providing a first board;

creating a ground plane on a first side of the first board;

providing a second hoard;

integrating at least one pair of antennas with the second board, wherein a first antenna of the at least one pair of antennas is located next to a first edge of the second board and a second antenna of the at least one pair of antennas is located next to a second edge opposite the first edge; and coupling the second board with the first board in a position approximately perpendicular to the first board and approximately centered about the first board.

11. The method of claim 10, further comprising providing a corporate feed network on a second side of the first board and connecting the corporate feed network to the at least one pair of antennas.

12. The method of claim 11, further comprising the step of coupling a radio frequency connector to an edge of the first board and electrically coupling the radio frequency connector to the corporate feed network.

13. The method of claim 10, wherein the step of coupling the second board further comprises inserting at least a portion of the second board into at least one slot formed in the first board.

14. The method of claim 10, wherein the step of integrating at least one pair of antennas with the second board further comprises integrating at least four pairs of dipole antennas with the second board.

* * * * *

UNITED STATES PATENT AND TRADEMARK OFFICE

CERTIFICATE OF CORRECTION

PATENT NO. : 7,180,461 B2
APPLICATION NO. : 11/190649
DATED : February 20, 2007
INVENTOR(S) : Petropoulos et al.

It is certified that error appears in the above-identified patent and that said Letters Patent is hereby corrected as shown below:

Col. 9, Claim 3, Line 1, "electncally" should be --electrically--.

Signed and Sealed this

Seventeenth Day of April, 2007

JON W. DUDAS
*Director of the United States Patent and Trademark Office*